US005218797A

United States Patent [19]

Kruse

[11] Patent Number: 5,218,797

[45] Date of Patent: Jun. 15, 1993

[54] PREFABRICATED PANEL ENCLOSURE SYSTEM

[75] Inventor: George D. Kruse, Folsom, Calif.

[73] Assignee: PPA Industries, Inc., Dallas, Tex.

[21] Appl. No.: 790,496

[22] Filed: Nov. 12, 1991

[51] Int. Cl.[5] ..... E02D 27/00

[52] U.S. Cl. ..... 52/169.9; 52/468

[58] Field of Search ..... 52/169.9, 169.12, 169.13, 52/DIG. 3, 282, 293, 584, 468, 467, 470, 582, 281, 239, 126.3, 126.4; 405/255, 284

[56] References Cited

U.S. PATENT DOCUMENTS

| | | | |
|---|---|---|---|
| 2,577,323 | 12/1951 | Goenner | 52/293 |
| 2,664,740 | 1/1954 | Cochrane . | |
| 2,708,494 | 5/1955 | Larsen . | |
| 3,330,084 | 7/1967 | Russell | 52/281 X |
| 3,350,828 | 11/1967 | Russell | 52/281 X |
| 3,780,481 | 12/1973 | Tomkins | 52/293 X |
| 4,035,972 | 7/1977 | Timmons | 52/281 X |
| 4,118,903 | 10/1978 | Coulthard | 52/239 X |
| 4,193,584 | 3/1980 | Wieser . | |
| 4,226,067 | 10/1980 | Artzer . | |
| 4,250,676 | 2/1981 | Presby | 52/239 X |
| 4,297,820 | 11/1981 | Artzer . | |
| 4,336,676 | 6/1982 | Artzer . | |
| 4,362,422 | 12/1982 | Zinkann et al. | 52/507 X |
| 4,601,146 | 7/1986 | Harter et al. . | |
| 4,614,013 | 9/1986 | Stevenson . | |
| 4,719,731 | 1/1988 | Ravotti et al. . | |
| 4,761,922 | 8/1988 | Black | 52/71 |
| 4,956,953 | 9/1990 | Bates | 52/584 X |

*Primary Examiner*—Carl D. Friedman
*Assistant Examiner*—Kien Nguyen
*Attorney, Agent, or Firm*—Lee, Mann, Smith, McWilliams, Sweeney & Ohlson

[57] ABSTRACT

A modular prefabricated panel enclosure system comprising a plurality of spaced apart posts, each post including a lower support bracket and an upper support bracket. Prefabricated wall panels are located between each set of spaced apart posts such that the lower corners of the panels are supported by the lower brackets and such that the upper corners of the panels are retained by the upper brackets. The lower support brackets support the deadload weight of the wall panels while the upper and lower brackets laterally support the wall panels. Pilaster panels are attached to the upper and lower brackets on each side of the wall panels to provide continuity between the adjacent wall panels. The panel system may be erected by hand without the use of lifting devices and may be disassembled and reassembled into various different configurations as desired.

16 Claims, 4 Drawing Sheets

FIG. 1
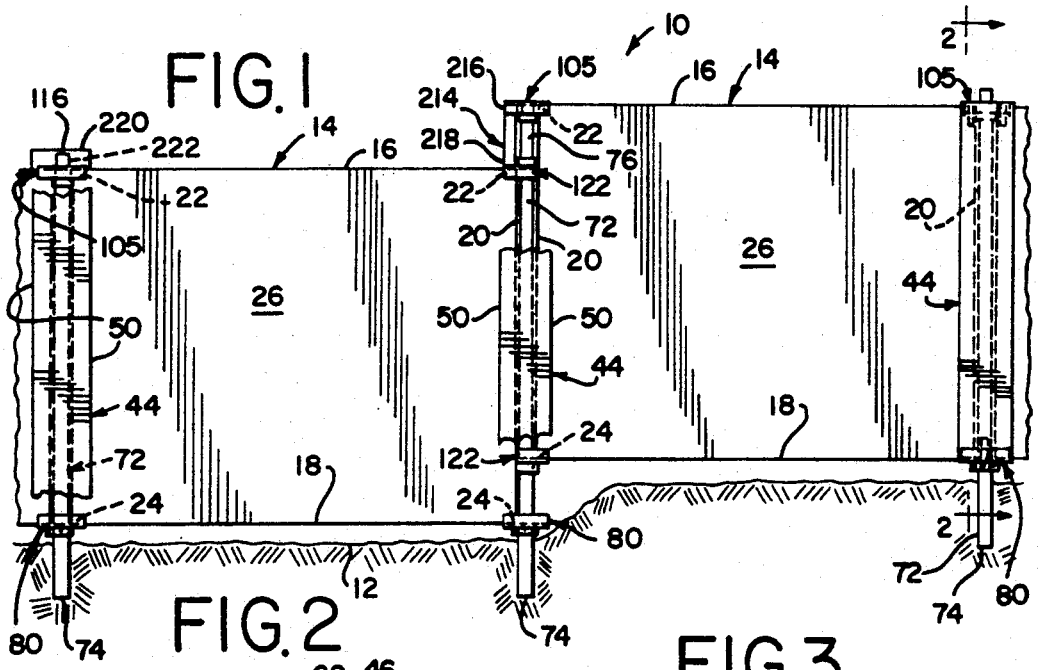
FIG. 2
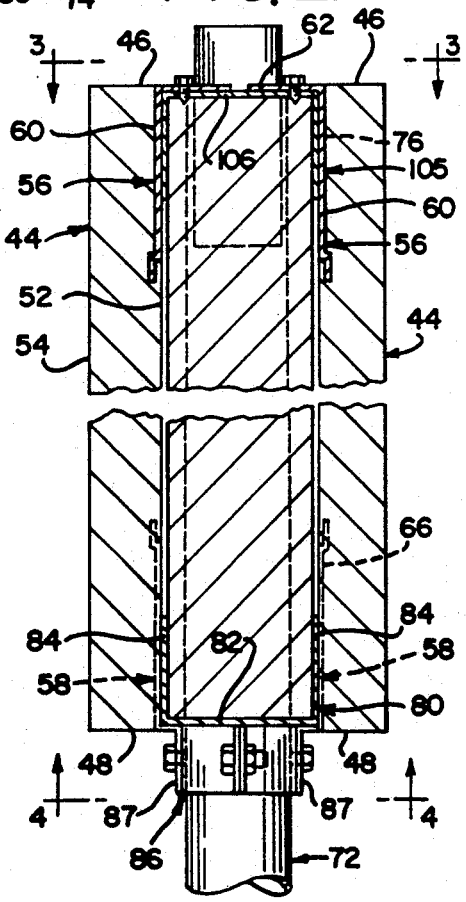
FIG. 3
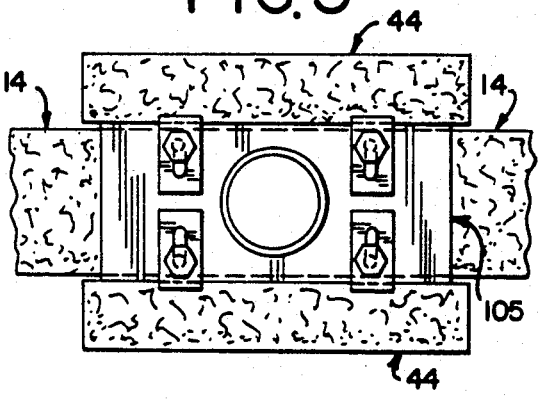
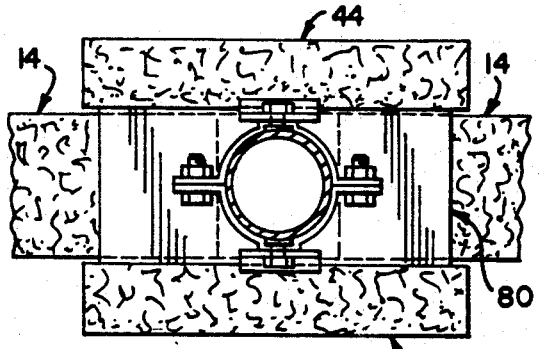
FIG. 4

PREFABRICATED PANEL ENCLOSURE SYSTEM

BACKGROUND OF THE INVENTION

The present invention relates to prefabricated wall enclosure systems and in particular to prefabricated exterior wall enclosure systems which are light-weight and erected by hand without the use of lifting devices.

Exterior enclosure systems such as chain-link fences generally include pipe support posts and chain-link fence fabric. Chain-link fence enclosures have been popular as chain-link fencing can be easily and quickly installed by hand with a minimum amount of labor and without the need for any lifting devices such as cranes or hoists. Chain-link fences, however, often do not provide as much privacy, sound abatement, or as pleasing an aesthetic appearance as is desired. Masonry walls which may be made of materials such as brick, stone or concrete have also been used as enclosures. Masonry wall enclosure systems often require the installation of footings as masonry walls are very heavy. Masonry walls also require a large amount of time and labor to construct. There has therefore been a need for a wall enclosure system which provides the aesthetic, privacy and sound abatement advantages of masonry wall enclosures, but which also provides the advantages of chain-link fencing in that the wall enclosure is light-weight and prefabricated so that the wall enclosure may be easily and quiclly installed by hand with a minimum amount of labor and without the need for any lifting devices.

SUMMARY OF THE INVENTION

The present invention provides a modular prefabricated wall panel enclosure system comprising a plurality of spaced apart support posts which are partially set into the ground. A lower support bracket is attached to each post at any desired location. The lower brackets are generally U-shaped in cross-section and provide a receiving pocket on each side of the post. Prefabricated wall panels are placed between adjacent posts such that each bottom corner of a wall panel is inserted into the receiving pocket of a respective lower bracket. Upper brackets are attached to the top end of each post such that an upper bracket receives the upper corner of each adjacent wall panel. The lower brackets provide vertical support for the wall panels while both the lower and upper brackets provide lateral support for the wall panels. Pilaster panels are placed on one or both sides of each post as desired and are fastened to the upper bracket and lower bracket. The pilaster panels extend the height of the wall panels and overlap with the wall panels on each side of the post to provide a wall with a continuous and pleasing aesthetic appearance. The wall and pilaster panels include a light-weight core having a three dimensional welded wire frame with polystyrene filter blocks. A fiberglass reinforced polymer based stucco coating is applied to the core to provide a wall panel surface with various different textures as desired. A vinyl acrylic coating is placed over the stucco coating to provide a tough and durable outer surface.

DESCRIPTION OF THE DRAWINGS

FIG. 1 is a side elevational view of the prefabricated wall enclosure system showing a series of adjacent wall panels with a change in elevation.

FIG. 2 is an end cross sectional view taken along lines 2—2 of FIG. 1.

FIG. 3 is a top plan view taken along lines 3—3 of FIG. 2.

FIG. 4 is a bottom cross sectional view taken along lines 4—4 of FIG. 2.

DESCRIPTION OF THE PREFERRED EMBODIMENT

Figure 5:
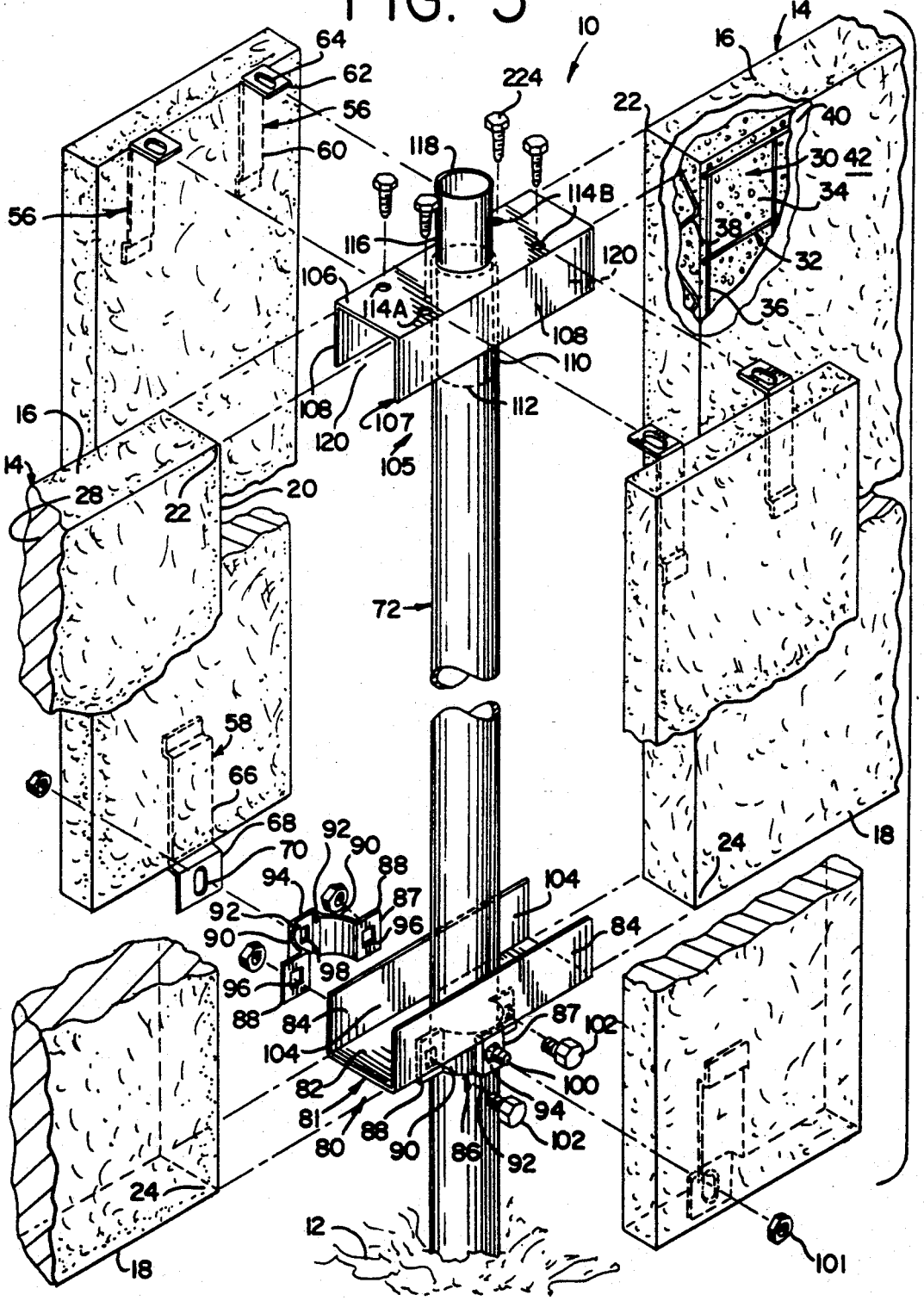
FIG. 5 is an exploded view of one joint of the wall enclosure system.

The prefabricated panel enclosure system 10 is shown in FIG. 1 supported by the ground 12. The panel system 10 illustrated includes a plurality of prefabricated wall panels 14. Each wall panel 14 is generally rectangular and includes a top edge 16 and a bottom edge 18 which is generally parallel to the top edge 16. A lateral edge 20 extends between the bottom edge 18 and the top edge 16 at each end of the wall panel 14. The top edge 16 forms an upper corner 22 with each lateral edge 20. The bottom edge 18 forms a lower corner 24 with each lateral edge 20. The wall panel 14 also includes a generally planar interior surface 26 and a parallel and spaced apart generally planar exterior surface 28. While the panels 14 are preferably generally rectangular and planar, various other configurations may be used. For example, the interior and exterior surfaces 26 and 28 may be curved, the top and bottom edges 16 and 18 may be arched, or the panels 14 could be in the general shape of a right triangle or other geometric shape. The panels 14 are preferably approximately three and one-quarter inches thick, eight feet wide and either two feet, four feet or six feet high.

Each wall panel 14 includes a core 30 having a three-dimensional welded wire frame 32 and a plurality of filler blocks 34. The wire frame 32 includes two rectangular wire grids 36 (only one shown) which are spaced apart parallel to one another. A plurality of bent-wire web members 38, best seen in FIG. 5, are attached to and extend between the two grids 36. The web members 38 are spaced apart parallel to one another. The filler blocks 34 are located between the wire grids 36 and the web members 38. The construction of the core 30 is generally described in U.S. Pat. Nos. 4,226,067, 4,297,820 and 4,336,676. The wire frame 32 is preferably made of aluminized steel and the filler blocks 34 are preferably made of polystyrene. A coating 40 is applied over the core 30 by troweling or other well known application means. The coating 40 embeds portions of the wire frame 32 and may be provided with various different surface textures as desired. The coating 40 is preferably a light-weight fiberglass reinforced polymer based stucco sold under the trademark FLEXI-ROCK by Flexi-Rock, Inc. in Tempe, Ariz. Other types of coatings 40 may be used as desired, however, they should preferably be light-weight and durable. A surface coating 42 is applied over the coating 40 by spraying or other well known application means. The surface coating 42 is preferably a vinyl acrylic sold under the trademark TRIKO-PLEX by Proko Industries, Inc. in Mesquite, Tex. The surface coating 42 provides the wall panels 14 with a flexible, long-lasting, mildew resistent outer surface. The surface coating 42 may be applied in various different colors as desired.

The wall system 10 also includes a plurality of pilaster panels 44. Each pilaster 44 is generally rectangular and includes a top edge 46 which is spaced apart and parallel to a bottom edge 48. Lateral edges 50 extend between the top edge 46 and the bottom edge 48 at each side of the pilaster 44. Each pilaster 44 also includes an interior surface 52 which is generally planar and which is spaced apart and parallel to a generally planar exterior surface 54. Each pilaster 44 is constructed in the same general manner as the wall panels 14 are constructed. The pilasters 44, however, additionally include two upper locking clips 56 and one lower locking clip 58. Each upper locking clip 56 includes a generally Z-shaped leg 60 and a tab 62 which extends generally perpendicular from one end of the leg 60. The tab 62 includes a slotted aperture 64. The leg 60 of each clip 56 is connected to the welded wire frame 32 which is within the pilaster 44. The upper locking clips 56 are located such that the legs 60 are embedded within the pilaster 44 and such that the tab 62 extends out of the pilaster 44 approximately flush with the top edge 46. The two upper locking clips 56 are located on each pilaster 44 such that the apertures 64 are spaced apart from one another a distance X.

The lower locking clip 58 also includes a generally Z-shaped leg 66 and a tab 68 which is generally parallel to, but offset from, the leg 66. The tab 68 includes a vertically slotted aperture 70. The lower locking clip 58 is attached to the welded wire frame 32 within the pilaster 44 equidistantly between the lateral edges 50. The clip 58 is located such that the leg 66 is embedded within the pilaster 44 and such that the tab 68 extends below the bottom edge 48. The pilasters 44 are preferably approximately three and one-quarter inches thick, ten inches wide, and may be of any height as required but are generally the same height as the panels 14.

The panel system 10 also includes a plurality of support posts 72. Each post 72 extends between a lower end 74 and an upper end 76. The posts 72 are set into the ground 12 such that the central axis of each post 72 is generally vertical. Each post 72 is spaced apart from an adjacent post 72 a uniform distance such that a wall panel 14 may be located between adjacent posts 72. The posts 72 are preferably spaced apart by a distance of approximately eight feet one inch between the exterior surfaces of the posts 72. The posts 72 are preferably round structural tubes or pipes and may be of various different diameters, however, a standard two and seven-eighth inch outer diameter is preferred. The length of the posts 72 may vary depending upon the height of the wall panels 14 and upon the distance the lower end 74 is set into the ground 12. While the posts 72 are preferably hollow, they may be filled with mortar or concrete if so desired. The posts 72 are preferably made of galvanized steel.

The panel system 10 also includes a plurality of support brackets. Various types of upper and lower support brackets may be used as conditions require. One type of bracket used in the panel enclosure system 10 is a lower support bracket 80, best shown in FIG. 5. The bracket 80 includes a generally U-shaped channel 81 having a generally horizontal web 82 and two generally vertical spaced apart flanges 84 attached to and extending upwardly from opposing sides of the web 82. The web 82 includes a circular aperture (not shown) centered in the web 82 through which the upper end 76 of a post 72 may be inserted. The lower support bracket 80 also includes a saddle clamp 86. The saddle clamp 86 includes two saddle clamp halves 87. Each saddle clamp half 87 includes two spaced apart coplanar flanges 88. A circular wall 90 extends from each flange 88 to a sidewall 92. Each sidewall 92 is generally perpendicular to the flanges 88. An end wall 94 extends between the sidewalls 92 and is generally parallel to the flanges 88. The flanges 88 each include a rectangular aperture 96 and the end wall 94 includes a rectangular aperture 98. The sidewalls 92 are spaced apart from one another such that when a fastener 100 is inserted through the aperture 98, the head of the fastener 100 will not be able to rotate between the sidewalls 92. A nut 101 is threadably attached to the fastener 100.

The saddle clamp halves 87 are adapted such that when they are placed around the posts 72 there will be a gap between the opposing flanges 88 of each saddle clamp half 87. Fasteners 102 are inserted through the apertures 96 of the saddle clamp halves 87. The fasteners 102 are tightened such that the saddle clamp halves 87 will releasably and securely grip the post 72. The saddle clamps 86 allow the bracket 80 to be positioned anywhere along the length of a post 72 as desired. One saddle clamp half 87 is preferably attached to the bottom of the web 82 of the lower bracket 80 by welding or other means and the other saddle clamp half 87 is preferably left loose until attached by the fasteners 102.

The web 82 and the flanges 84 create a hollow receiving pocket 104 within the bracket 80 on each side of the aperture (not shown) in the web 82 such that the pockets 104 will be located on each side of the post 72 when the support bracket 80 is attached to a post 72. Each pocket 104 is adapted to receive the lower corner 24 of a wall panel 14 such that the panel 14 is located between and closely adjacent to the flanges 84, with the bottom edge 18 resting on the web 82 and with the lateral edge 20 being adjacent the post 72.

Another type of support bracket used in the panel system 10 is an upper support bracket 105, best shown in FIG. 5. The bracket 105 includes a generally U-shaped channel 107 having a generally horizontal web 106 and two spaced apart generally vertical flanges 108 attached to and extending downwardly from opposing sides of the web 106. The bracket 105 also includes a tubular lower stem 110. The lower stem 110 is centrally located on and attached to the web 106 and extends downwardly therefrom to a lower end 112. The lower stem 110 is adapted to fit closely within the walls of the post 72. Alternately, the lower stem 110 may be adapted such that the post 72 may be inserted within the lower stem 110. The bracket 105 also includes two sets of apertures 114A and 114B which are spaced apart a distance X and which are located in the web 106 so as to align with the slotted apertures 64 in the upper locking clips 56 of the pilasters 44. The bracket 105 may also include a tubular upper stem 116 which is coaxially located with respect to the lower stem 110 and which extends from the web 106 to an upper end 118. The stems 110 and 116 may be formed from a single tube which extends through the web 106 or they may be made of separate tubes attached to opposite sides of the web 106. The upper end 118 may be threaded if desired. The web 106 and flanges 108 of the bracket 105 form a hollow receiving pocket 120 on each side of the lower stem 110 such that the pockets 120 will be located on each side of a post 72. The pockets 120 are adapted to receive the upper corner 22 of a wall panel 14 such that the panel 14 is located between and closely adjacent to the flanges 108 with the web 106 resting on the top edge 16 of the panel 14 and with the lateral edge 20 being adjacent the post 72.

Figure 6:
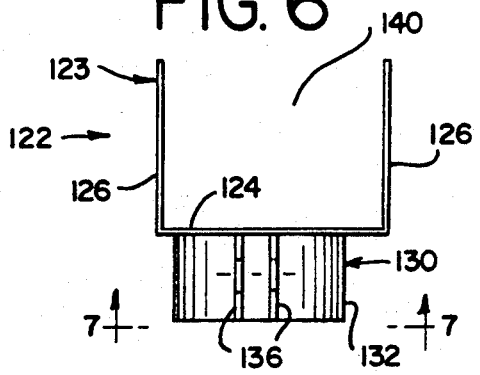
FIG. 6 is a side elevational view of a step bracket.
Figure 7:
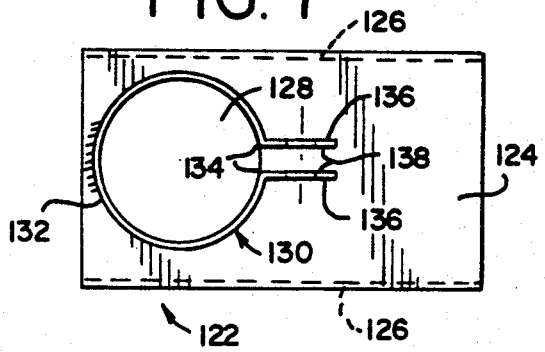
FIG. 7 is a bottom view of a step bracket taken along lines 7—7 of FIG. 6.

FIGS. 6 and 7 show a step bracket 122 which may also be used with the panel system 10. The bracket 122 includes a generally U-shaped channel 123 having a web 124 and a pair of spaced apart parallel flanges 126 which are attached to opposing sides of the web 124. The web 124 includes a circular aperture 128 which is located near one end of the web 124 which is sized such that the upper end 76 of a post 72 may be inserted therethrough. The bracket 122 includes a brace band clamp 130. The brace band clamp 130 includes a generally circular wall 132 terminating at ends 134. The circular wall 132 is located concentrically with the aperture 128. A flange 136 extends from each end 134 of the wall 132 such that the flanges 136 are spaced apart parallel to one another. Each flange 136 includes an aperture 138 for the insertion of a bolt or other fastener means therethrough. The fastener tightens the flanges 136 together such that the clamp 130 will releasably and securely grip the post 72. The step bracket 122 includes a single receiving pocket 140 formed by the web 124 and the flanges 126 which is adapted to receive either an upper corner 22 or a lower corner 24 of a wall panel 14. The step bracket 122 is designed for use in situations where adjacent wall panels 14 are supported at different heights as illustrated in FIG. 1.

Figure 8:
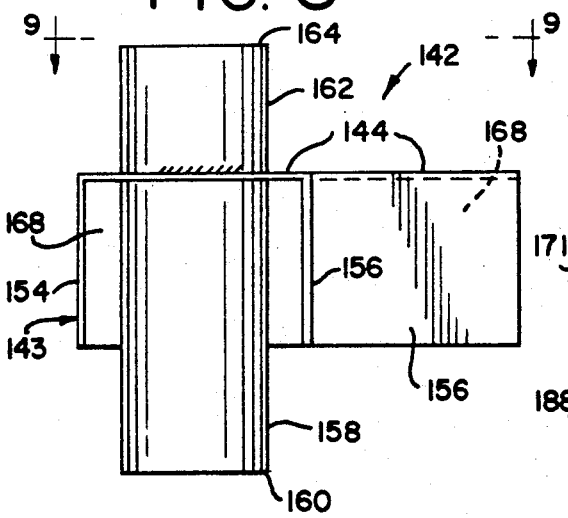
FIG. 8 is a side elevational view of a top corner bracket.
Figure 9:
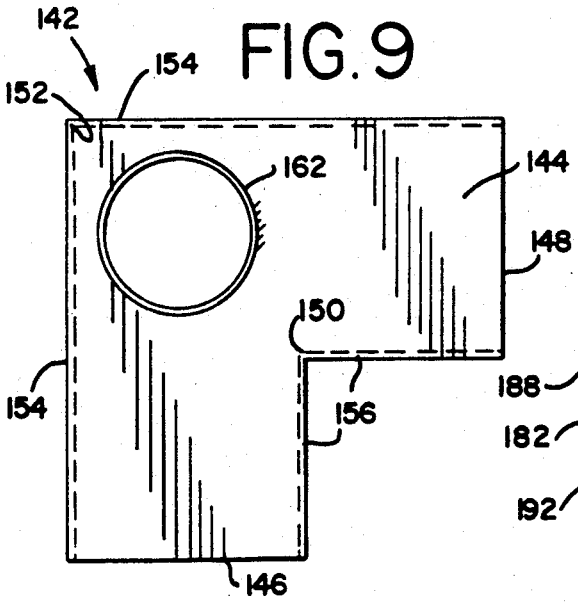
FIG. 9 is a top plan view taken along lines 9—9 of FIG. 8.

FIGS. 8 and 9 show an upper corner bracket 142 which may also be used in connection with the panel system 10. The bracket 142 includes a channel 143 which is generally U-shaped in cross-section. The channel 143 includes a generally L-shaped web 144. The web 144 includes a first end 146, a second end 148, an interior corner 150 and an exterior corner 152. A flange 154 is attached to one side of the web 144 and extends from the first end 146 to the exterior corner 152 and to the second end 148. A flange 156 is attached to the opposite side of the web 144 and extends from the first end 146 to the interior corner 150 and to the second end 148. A lower tubular stem 158 is attached to the web 144 near the corner 152 and extends downwardly therefrom to a lower end 160. The stem 158 is adapted to be insertable within the upper end 76 of a post 72. Alternately, the stem 158 can be adapted to fit over the upper end 76 of a post 72. An upper stem 162 is attached to the web 144 concentric with the lower stem 158 and extends upwardly therefrom to an upper end 164. The upper stem 162 may be threaded if desired. The stems 158 and 162 may be formed from a single tube which extends through the web 144 or may be made of separate tubes attached to opposite sides of the web 144. The web 144 and the flanges 154 and 156 form two pockets 168 respectively located at the first end 146 and at the second end 148 of the upper corner bracket 142.

Figure 10:
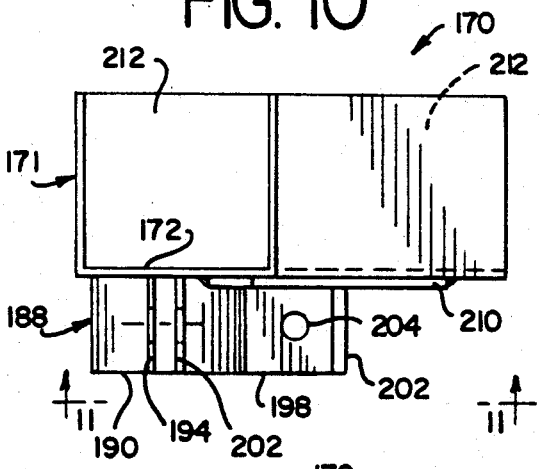
FIG. 10 is a side elevational view of a bottom corner bracket.
Figure 11:
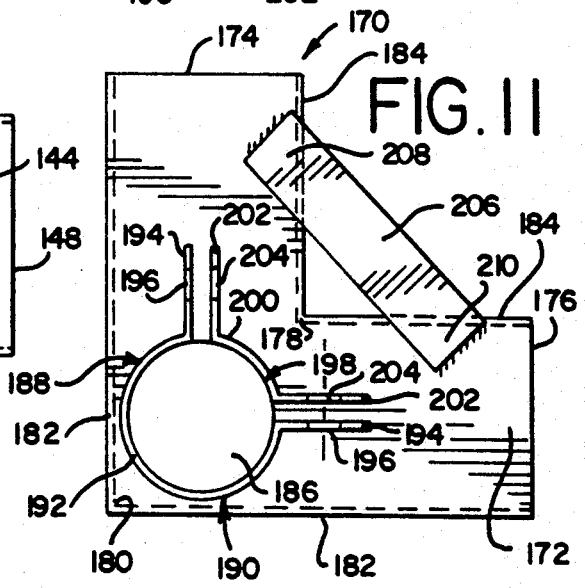
FIG. 11 is a bottom view taken along lines 11—11 of FIG. 10.

FIGS. 10 and 11 show a lower corner bracket 170 which may be used in the panel system 10. The lower corner bracket 170 includes a channel 171 which is generally U-shaped in cross-section and which includes a generally L-shaped web 172 having a first end 174, a second end 176, an interior corner 178 and an exterior corner 180. A flange 182 is attached to one side of the web 172 and extends from the first end 174 to the corner 180 and to the second end 176. A flange 184 is attached to the opposite side of the web 172 and extends from the first end 174 to the corner 178 and to the second end 176. The web 172 includes a circular aperture 186 located adjacent the corner 180 which is sized such that the upper end 76 of a post 72 may be inserted therethrough. The bracket 170 includes a saddle clamp 188. The saddle clamp 188 includes a first portion 190 having a circular wall 192 and a flange 194 attached to and extending from each end of the wall 192. The wall 192 is preferably attached to the web 172 by welding or other means. Each of the flanges 194 include an aperture 196. The saddle clamp 188 also includes a second portion 198. The second portion 198 includes a circular wall 200 and a flange 202 extending from each end of the wall 200. Each flange 202 includes an aperture 204. The walls 192 and 200 are adapted to be positioned concentric to the aperture 186 in the web 172 such that the flanges 194 and 202 are spaced apart parallel to one another. A bolt or other fastener means may be inserted through the apertures 196 and 204 to tighten the flanges 194 and 202 together around a post 72 thereby releasably securing the bracket 170 to the post 72. A bar 206 has a first end 208 attached to the web 172 at the first end 174 and a second end 210 attached to the web 172 at the second end 176. The web 172 and the flanges 182 and 184 form two receiving pockets 212 respectively located at the first end 174 and at the second end 176 of the bracket 170. While the pockets 168 and 212 of the upper and lower corner brackets 142 and 170 are shown being located at approximately a ninety degree angle to one another the pockets 168 and 212 may be located at other angles as desired such that various different wall configurations may be formed.

The panel system 10 may also include one or more end fill panels 214, best shown in FIG. 1. The end panels 214 are constructed in the same manner as are the wall panels 14. The end panel 214 extends between an upper end 216 and a lower end 218. The end panel 214 is adapted to fit within and fill the pockets 104 and 120 in the brackets 80 and 105. The end panel 214 is preferably approximately two inches wide, three inches thick and any length as required.

The panel system 10 may also include one or more top covers 220, best shown in FIG. 1. The top covers 220 are constructed in the same manner as are the wall panels 14 and include a recessed chamber 222 adapted to receive the upper stem 116 or 162 of the brackets 105 and 142. The top covers 220 are sized so as to cover the brackets 105 and 142 as well as the top edges 46 of the pilaster panels 44 which are attached thereto.

In operation, the posts 72 are set into the ground 12 such that the upper end 76 is located at a predetermined elevation and such that the lower end 74 is located a sufficient distance into the ground 12 to provide adequate support for the panel system 10. The lower end 74 of the posts 72 may be set in concrete if so desired. As shown in FIG. 1, the upper end 76 of the posts 72 may be set to different elevations as required to conform to ground surface elevation changes or other conditions. The posts 72 are set such that their central axes are generally vertical and such that the posts 72 are spaced apart from adjacent posts 72 by a distance of approximately eight feet one inch between the outer surfaces of the posts 72 to provide approximately one-half inch of clearance between the lateral edge 20 of the wall panel 14 and the adjacent post 72.

A lower support bracket 80 is attached to a post 72 where the wall panels 14 to be supported by the post 72 are intended to be located generally in line with one another on each side of the post 72. The lower bracket 80 is placed over the upper end 76 of the post 72 such that the upper end 76 extends through the aperture (not shown) in the web 82 of the lower line bracket 80. The saddle clamp halves 87 are loosely attached to one another with the fasteners 102 such that the lower bracket 80 may be slid upwardly or downwardly along the post 72 as desired. The lower bracket 80 is positioned on the post 72 such that the top of the web 82 is located at a predetermined and desired elevation. The fasteners 102 are then tightened such that the saddle clamp halves 87 grip the post 72 such that the bracket 80 is releasably attached to the post 72.

A lower corner bracket 170 is attached to a post 72 where the wall panels 14 to be supported by the post 72 are intended to be located out of line with one another, such as at corners or turns in the wall system 10. The lower corner bracket 170 is placed over the upper end 76 of the post 72 such that the upper end 76 extends through the aperture 186 in the web 172. The first portion 190 of the saddle clamp 188 is loosely attached to the second portion 198 of the saddle clamp 188 such that the lower corner bracket 170 may be slid upwardly or downwardly along the post 72 to any desired elevation. When the lower corner bracket 170 is located at the desired elevation, the first and second portions 190 and 198 of the saddle clamp 188 are tightened together such that the lower corner bracket 170 is releasably attached to the post 72.

Once the lower brackets 80 and 170 are fastened in place on their respective posts 72, a wall panel 14 may be tilted upright and placed between two adjacent posts 72 such that each lower corner 24 of the wall panel 14 is located in a hollow pocket 104 in the lower brackets 80 which are attached to the adjacent posts 72. Where a wall panel 14 is being placed adjacent a post 72 which has a lower corner bracket 170 attached to it, the lower corner 24 of the panel 14 is inserted into the pocket 212 of the bracket 170.

When two wall panels 14 have been positioned on each side of a post 72 and placed in both pockets 104 of the lower brackets 80, an upper support bracket 105 is then attached to the upper end 76 of the post 72. The lower stem 110 of the upper bracket 105 is inserted within the post 72 such that the upper corners 22 of each adjacent wall panel 14 are located in a respective pocket 120 of the upper bracket 105. The lower stem 110 is inserted into the post 72 until the lower surface of the web 106 contacts the top edge 16 of the wall panels 14. Where the wall panels 14 are located adjacent a post 72 which includes a lower corner bracket 170, an upper corner bracket 142 is attached to the upper end 76 of the post 72 by inserting the lower stem 158 into the post 72.

As shown in FIG. 1, the step brackets 122 are used where adjacent wall panels 14 are attached to a post 72 at different elevations. One step bracket 122 is placed over the upper end 76 of the post 72 such that the pocket 140 is open upwardly. The step bracket 122 is lowered into the desired position whereupon the flanges 136 are tightened together such that the brace band 130 will releasably grip the post 72. This lower step bracket 122 receives the lower corner 24 of the higher elevation panel 14 in the pocket 140. A second step bracket 122 is also placed over the upper end 76 of the post 72 except with the pocket 140 being open downwardly. The upper step bracket 122 is lowered into position whereupon the flanges 136 are tightened together such that the brace band 130 releasably grips the post 72. The upper step bracket 122 receives the upper corner 22 of the lower elevation wall panel 14 in the pocket 140. The aperture 128 is located in the web 124 of the step bracket 122 such that the web 124 and the flanges 126 do not interfere with the wall panel 14 on the opposite side of the post 72.

A pilaster panel 44 is attached to the upper bracket 105 and to the lower bracket 80. The pilaster panel 44 is located adjacent the post 72 such that it extends beyond the lateral edges 20 of the adjacent wall panels 14 thereby covering the posts 72 and any gaps between the posts 72 and the adjacent wall panels 14. The tabs 62 of the upper locking clips 56 are located on the top of the web 106 of the upper line bracket 105 such that the slotted apertures 64 are aligned with the apertures 114A and 114B. Fasteners 224 are then inserted through the apertures 64 and 114A and 114B and are secured to the upper line bracket 105. The tab 68 of the lower locking clip 58 is placed adjacent the end wall 94 of the saddle clamp half 87 such that the fastener 100 extends through the slotted aperture 70. The nut 101 is then attached to the fastener 100 and tightened such that the lower locking clip 58 is securely attached to the saddle clamp 86. Pilaster panels (not shown), which correspond to the shape of the corner brackets 142 and 170 are attached to the upper corner bracket 142 and to the lower corner bracket 170. Caulk or other means for forming a seal may be placed between the lateral edges 50 of the pilaster panels 44 and the wall panels 14. A pilaster panel 44 may be attached to each side of the post 72 or may be attached to only one side of the post 72 if desired or where access to one side of the wall panels 14 is limited.

The end panels 214 are used where only a single wall panel 14 is supported by a post 72, such as at the end of the panel system 10. In such a situation, only one of the two pockets 104 and 120 in each of the brackets 80 and 105 are filled by the wall panel 14 leaving the remaining pockets 104 and 120 on the opposite side of the post 72 empty. A gap is therefore formed between the pilaster panels 44 which are attached to each side of the brackets 80 and 105. The end panel 214 is placed in this gap with the upper end 216 being located in the pocket 120 and with the lower end 218 being located in the pocket 104 such that the gap between the pilaster panels 44 is filled.

The end panel 214 is also used, as shown in FIG. 1, where there is a change in elevation between adjacent wall panels 14. As shown in FIG. 1, the upper end 216 of the end panel 214 is located in the pocket 120 of the bracket 105. The lower end 218 is located on top of the web 124 of the step bracket 122. The end panel 214 is sandwiched between the two pilaster panels 44.

The top covers 220 may be placed over the upper stem 116 and 162 of the upper brackets 105 and 142. If it is desired to place barbed wire along the top of the panel enclosure system 10, the top covers 220 may be left off, and conventional barb arms may be attached to the upper stem 116 of the line brackets 105 and to the upper stem 162 of the upper corner brackets 142.

The lower brackets 80 and 170 support the entire deadload weight of the wall panels 14 at or near ground level thereby providing increased stability to the panel system 10. The upper brackets 105 and 142, the lower brackets 80 and 170, and the step brackets 122 automatically center the deadload weight of the wall panels 14 on the center line of the posts 72 thereby preventing the posts 72 from leaning or bowing. The upper brackets 105 and 142 and the lower brackets 80 and 170 permit the installation of the wall panels 14 such that the bottom edge 18 may be above, below, or flush with ground level. Locating the bottom edge 18 of the wall panels 14 above the ground level is beneficial for kennel applications, refuse container enclosures and other installations where trimming or cleaning under the wall panels 14 is desired. The modular components of the panel system 10 permit the entire panel system 10 to be disassembled, relocated and reassembled at a different location or in a new configuration reusing all of the panel system components except for possibly the posts 72. The panel system 10 may be erected from only one side of the panel system 10 and therefore may be located closely adjacent to existing walls or other obstructions which limit access to one side of the panel system 10. In applications where the bottom edge 18 of the wall panels 14 is located below ground level, both sides of the wall panel 14 should be uniformly backfilled as the panel enclosure system 10 is not intended for use as a retaining wall.

Figure 13:
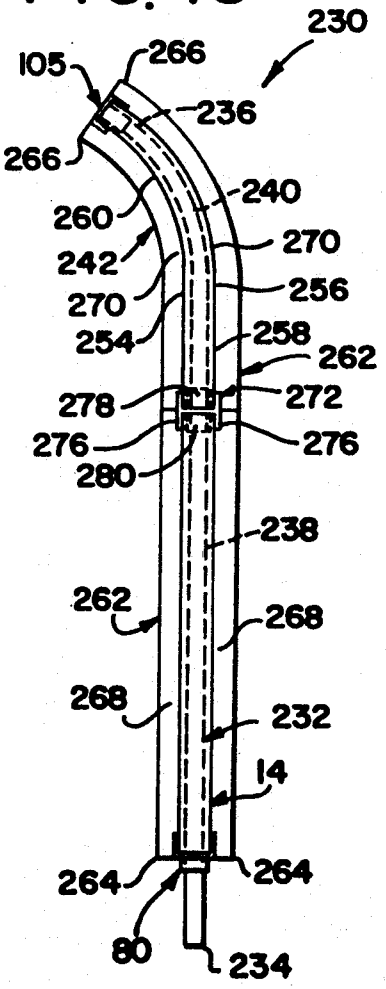
FIG. 13 is a cross sectional view taken along lines 13—13 of FIG. 12.
Figure 12:
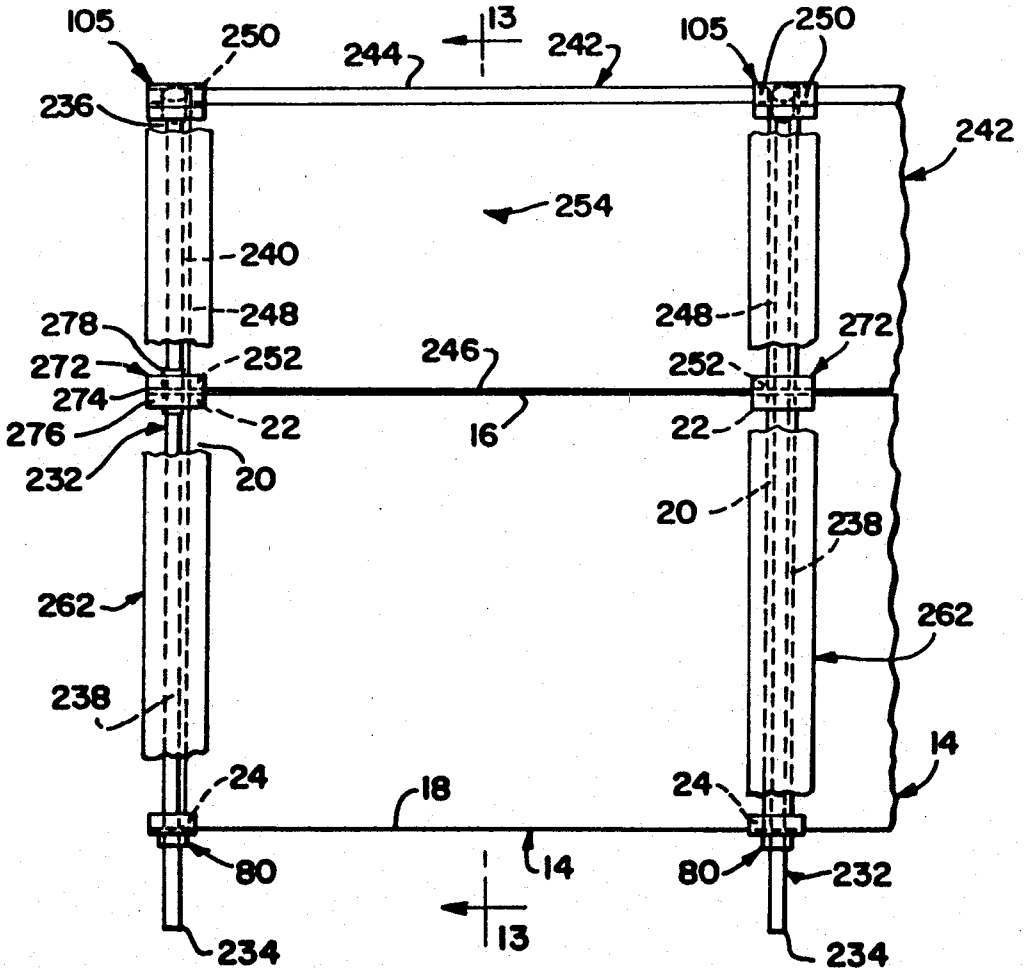
FIG. 12 is a side elevational view of the prefabricated wall enclosure system showing a curved wall panel.

Another embodiment of the panel system is shown in FIGS. 12 and 13 as panel system 230. The panel system 230 includes a plurality of spaced apart support posts 232. Each post 232 extends between a lower end 234 and an upper end 236 and includes a lower linear portion 238 and an upper curved portion 240. The posts 232 are preferably round structural tubes. The upper curved portion 240 of the post 232 may conform to an arc of a circle or various other curves as desired.

The panel system 230 also includes a plurality of curved wall panels 242. Each wall panel 242 includes a top edge 244 and a bottom edge 246 which is generally parallel to the top edge 244. A lateral edge 248 extends between the bottom edge 246 and the top edge 244 at each end of the curved wall panel 242. The top edge 244 forms an upper corner 250 with each lateral edge 248. The bottom edge 246 forms a lower corner 252 with each lateral edge 248. The curved panel 242 includes an interior surface 254 and an exterior surface 256. The curved panel 242 also includes a lower generally planar portion 258 and an upper curved portion 260. The curved portion 260 conforms to the curved portion 240 of the posts 232. The panels 242 are constructed in the same manner as are the wall panels 14.

The wall panel system 230 also includes a plurality of pilaster panels 262. Each pilaster panel 262 extends between a lower end 264 and an upper end 266. Each pilaster panel 262 includes a lower planar portion 268 and an upper curved portion 270. The pilaster panels 262 are constructed in the same manner as are the pilaster panels 44 and include locking clips for attachment to support brackets.

A bracket 272 is shown in FIGS. 12 and 13. The bracket 272 includes a horizontal web 274 and two spaced apart flanges 278 attached to and extending upwardly and downwardly from opposing sides of the web 274. A sleeve 278 extends through the web 274 and is adapted such that a post 232 may be inserted therethrough. The bracket 272 includes a lower and an upper receiving pocket 280 on each side of the sleeve 278. The bracket 272 is adapted to receive and support the upper corners 22 of two adjacent lower wall panels 14 and to receive and support two lower corners 24 or 252 of two adjacent upper wall panels 14 or 242 which are located above the lower wall panels 14.

As shown in FIGS. 12 and 13, a lower support bracket 80 is attached to each post 232 at a desired elevation. The lower corners 24 of a wall panel 14 are supported by the brackets 80 on adjacent posts 232. The brackets 272 receive and support the upper corners 22 of the panel 14. The lower corners 252 of the curved wall panel 242 are also received and supported by the bracket 272. An upper support bracket 105 is attached to the upper end 236 of the post 232 to receive and support the upper corners 250 of the curved panel 242. A pilaster panel 262 is attached to the lower bracket 80 and to the upper bracket 105. The pilaster panel 262 may also be attached to the bracket 272. The pilaster panel 262 extends beyond the lateral edges of the adjacent panels 14 and 242 thereby covering the posts 232 and any gaps between the posts 232 and the wall panels 14 and 242. A pilaster panel 262 may be attached to each side of a post 232 or to only one side if desired. The curved wall panels 242 are especially useful for sound abatement purposes as the concave curved portion 260 on the interior surface 254 increases the amount of sound that the wall system 230 will reflect.

The posts 232 can be replaced with wide flange columns (not shown). The wide flange columns are spaced apart with their webs parallel to one another. The panels 14 and 242 are located between adjacent wide flange columns such that the lateral edges 20 and 248 are received and supported between the flanges of the columns. The columns are adapted to be placed in the ground and to extend above the ground a sufficient distance to engage the lower planar portion 258 of the panel 242 but such that the top end of the column is located below the upper curved portion 260 of the panel 242.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A panel system comprising:

a plurality of spaced-apart posts, each said post extending between an upper end and a lower end;

a plurality of lower support brackets, at least one said lower support bracket being attachable to one post, each said lower support bracket including first means for releasably attaching said lower support bracket to said post;

a plurality of upper support brackets, at least one said upper support bracket being attachable to one post, each said upper support including second means for releasably attaching said upper support bracket to said post;

at least one wall panel, said wall panel extending between a first lateral edge and a second lateral edge, each said lateral edge extending between a lower corner and an upper corner, each said panel being positionable between adjacent posts such that each said bottom corner is supported by a respective lower support bracket and each said upper corner is supported by a respective upper support bracket, whereby said panel is supported vertically by said lower support brackets and is supported laterally by said upper and lower support brackets;

at least one pilaster panel having an upper end and a lower end; an upper attachment clip for releasably attaching said pilaster panel to said upper support bracket; and a lower attachment clip for releasably attaching said pilaster panel to said lower support bracket, said pilaster panels being adapted to overlie and cover the space between adjacent wall panels and to cover said posts.

2. The panel system of claim 1 wherein said lower support brackets comprise a generally U-shaped channel including an aperture through which said upper end of said post may be inserted.

3. The panel system of claim 2 wherein said lower support bracket includes a plurality of pockets adapted to respectively receive a lower corner of said wall panel.

4. The panel system of claim 1 wherein said first means for attachment comprises a saddle clamp.

5. The panel system of claim 1 wherein said upper support bracket comprises a generally U-shaped channel.

6. The panel system of claim 5 wherein said upper support bracket includes a plurality of pockets adapted to respectively receive an upper corner of said wall panel.

7. The panel system of claim 1 wherein said second attachment means comprises a stem adapted for insertion into said upper end of said post.

8. The panel system of claim 1 wherein said second attachment means comprises a stem adapted such that said upper end of said post may be inserted into said stem.

9. The panel system of claim 1 wherein said wall panel comprises:

a wire frame;

a plurality of filler blocks located within said frame; and an exterior coating applied over said frame and said filler blocks.

10. The panel system of claim 9 wherein said wall panel additionally comprises an acrylic surface coating applied over said exterior coating.

11. A panel system comprising:

a plurality of spaced-apart posts, each said post extending between an upper end and a lower end;

a plurality of lower support brackets, at least one said lower support bracket being attachable to one post, each said lower support bracket including a saddle clamp for releasably attaching said lower support bracket to said post;

a plurality of upper support brackets, at least one said upper support bracket being attachable to one post, each said upper support bracket including second means for releasably attaching said upper support bracket to said post; and at least one wall panel, said wall panel extending between a first lateral edge and a second lateral edge, each said lateral edge extending between a lower corner and an upper corner, each said panel being positionable between adjacent posts such that each said bottom corner is supported by a respective lower support bracket and each said upper corner is supported by a respective upper support bracket, whereby said panel is supported vertically by said lower support brackets and is supported laterally by said upper and lower support brackets.

12. The panel system of claim 11 additionally including at least one pilaster panel having an upper end and a lower end, each said pilaster panel including at least one upper attachment clip located at said upper end for releasably attaching said pilaster panel to said upper support bracket and a lower attachment clip located at said lower end for releasably attaching said pilaster panel to said lower support bracket, said pilaster panels being adapted to overlie and cover the space between adjacent wall panels and to cover said posts.

13. A panel system comprising:

a plurality of spaced-apart posts, each said post extending between an upper end and a lower end;

a plurality of lower support brackets, at least one said lower support bracket being attachable to one post, each said lower support bracket including first means for releasably attaching said lower support bracket to said post;

a plurality of upper support brackets, at least one said upper support bracket being attachable to one post, each said upper support bracket including a stem for releasably attaching said upper support bracket to said post; and at least one wall panel, said wall panel extending between a first lateral edge and a second lateral edge, each said lateral edge extending between a lower corner and an upper corner, each said panel being positionable between adjacent posts such that each said bottom corner is supported by a respective lower support bracket and each said upper corner is supported by a respective upper support bracket, whereby said panel is supported vertically by said lower support brackets and is supported laterally by said upper and lower support brackets.

14. The panel system of claim 13 additionally including at least one pilaster panel having an upper end and a lower end, each said pilaster panel including at least one upper attachment clip located at said upper end for releasably attaching said pilaster panel to said upper support bracket and a lower attachment clip located at said lower end for releasably attaching said pilaster panel to said lower support bracket, said pilaster panels being adapted to overlie and cover the space between adjacent wall panels and to cover said posts.

15. The panel system of claim 13 wherein said stem is adapted for insertion into said upper end of said post.

16. The panel system of claim 13 wherein said stem is adapted such that said upper end of said post may be inserted into said stem.

* * * * *